US006199490B1

(12) United States Patent
Langer

(10) Patent No.: US 6,199,490 B1
(45) Date of Patent: Mar. 13, 2001

(54) TELESCOPIC PLATFORM FOR RECEIPT OF LOADS

(75) Inventor: Heinz Langer, Kreuztal (DE)

(73) Assignee: "AFB" Anlagen-und Filterbau GmbH & Co. KG, Haiger-Sechshelden (DE)

( * ) Notice: Subject to any disclaimer, the term of this patent is extended or adjusted under 35 U.S.C. 154(b) by 0 days.

(21) Appl. No.: 09/194,955

(22) PCT Filed: Jun. 6, 1997

(86) PCT No.: PCT/EP97/02944

§ 371 Date: Mar. 29, 1999

§ 102(e) Date: Mar. 29, 1999

(87) PCT Pub. No.: WO97/47554

PCT Pub. Date: Dec. 18, 1997

(30) Foreign Application Priority Data

Jun. 8, 1996 (DE) ..... 196 23 022

(51) Int. Cl.[7] ..... A47B 11/00
(52) U.S. Cl. ..... 108/143; 414/282
(58) Field of Search ..... 108/20, 93, 102, 108/143; 414/282, 663, 662

(56) References Cited

U.S. PATENT DOCUMENTS

| | | | | |
|---|---|---|---|---|
| 3,934,741 | * | 1/1976 | Wentz | 414/663 |
| 4,003,296 | | 1/1977 | Wentz . | |
| 4,388,033 | | 6/1983 | Pipes . | |
| 5,207,555 | * | 5/1993 | Shirai | 414/282 |
| 5,275,064 | * | 1/1994 | Hobbs | 108/143 |
| 5,460,475 | | 10/1995 | Lloyd et al. . | |
| 5,839,873 | * | 11/1998 | Lloyd et al. | 414/282 |

FOREIGN PATENT DOCUMENTS

| | | |
|---|---|---|
| 1781068 | 12/1970 | (DE) . |
| 0410286 | 1/1991 | (EP) . |
| 1528823 | 5/1968 | (FR) . |
| 2520716 | 8/1983 | (FR) . |
| 2709745 | 3/1995 | (FR) . |
| 9404447 | 3/1994 | (WO) . |

* cited by examiner

*Primary Examiner*—Peter M. Cuomo
*Assistant Examiner*—Gerry Anderson
(74) *Attorney, Agent, or Firm*—Friedrich Kueffner

(57) ABSTRACT

A telescoping table with a base and at least two slides and a support table, which can be displaced linearly on it in a telescoping manner, and with drive devices assigned to these components, is to be operated in such a way that, even at small degrees of extension, at least the support table is fully or almost fully extended on the slide which guides it, and, to the extent possible, the second slide is also extended relatively far forward on the first slide, the required drive devices being installed in readily accessible and easy-to-maintain locations. For this purpose, it is proposed that the base be equipped with two drive devices, the first of which is connected only to the first slide, whereas the second operates tension cables, tension belts, tension bands, tension chains, and/or lengths of chain which operate a second slide or a second slide plus additional slides as well as the support table.

10 Claims, 2 Drawing Sheets

TELESCOPIC PLATFORM FOR RECEIPT OF LOADS

BACKGROUND OF THE INVENTION

1. Field of the Invention

The invention pertains to a telescoping table with a base and at least two slides and a support table, which are guided in linear fashion on the base in a telescoping manner, and with at least two drive devices mounted on the base, one of which is connected by drive means to the first slide only, whereas the second operates cables or lengths of chain, which move the second slide or the second slide plus additional slides as well as the support table.

2. Description of the Related Art

Telescoping tables of this type are used, for example, in high-shelf warehouses to load the shelving compartments with goods an d to remove the s tacked goods again later. The distance by which the telescoping table can extend inward is limited by the width of the aisle between the shelving units; often, however, not only normal but also oversized extensions are required, when, for example, two pallets are to be stored one behind the other in a deep shelf compartment, or when special conditions must be dealt with such as the presence of a fire wall. Although it is possible not only to extend the individual slides and the support table fully to achieve the optimum telescopic extension but also, in principle, to extend them only partially to achieve smaller telescopic extensions, the conventional drive devices of the slides and of the support table are designed in such a way that the end surfaces of the support table and of, for example, the two slides following along after it are so close together when only partially extended that the two slides which support the support table must also enter the shelf compartment. Therefore, with respect to the maximum height of the load which can be accepted, it is necessary to take into account the height not only of the support table itself but also of the slides which guide it.

As a way of eliminating this disadvantage, EP 0,410,286 A2 proposes that the support table and the slides connected to it not be extended in the conventional manner, that is, in a chronologically parallel or synchronous manner; instead, they are to be extended one after the other under the control of locking devices, so that, for example, when the support table is to telescope out only a short distance, the support table moves out first and then the slides which carry it move out, until the desired degree of extension is achieved. The extra complexity associated with the locking devices, however, is unfavorable. The jerky operation of the support table, caused by the acceleration and deceleration of the telescoping components in question, and the limitation on the speed at which the table can be extended under operating conditions of this type are also disadvantageous.

PCT WO 94/04,447 pertains to support forks which are designed to accept containers and discloses another possibility of keeping a large distance between the pick-up fork, which is provided in place of a support table, and the following slide even in cases where the fork is extended only a short distance. Namely, two drive devices, which are guided on the base, are assigned to the slides; one of these drives determines the displacement of the slides, while the other determines the displacement of the support table or support fork with respect to the preceding slide. One of the drive devices acts by way of shiftable gears or a gear boxes with different ratios. Thus, although the support table or support fork can always be extended fully with respect to the slides supporting and guiding it, the mounting of the drive devices, their energy supply lines, and the gear boxes subordinate to them on a slide present considerable difficulties. The transmission of the movement to the support table or support fork by way of any additional slides which might be provided also proves to be highly complicated and susceptible to breakdown.

FR-A-2,709,745 discloses a telescoping tab le, which is equipped with two drive devices, installed on the base, which move the slides and the support table; each of the drive devices drives an endless chain. One of these chains is attached to the first slide, the other to another endless belt, which for its part is attached to an endless belt in the following slide. Thus, although it is possible for the slides to be extended to different degrees in a controlled manner, the use of anchors extending crosswise to the chains to attach them impairs the precision of the control and the drive moments which can be generated to move the slides.

SUMMARY OF THE INVENTION

The invention is therefore based on the task of creating a telescoping table of the general type described above in which, even when the table is extended only a short distance, at least the support table is completely or almost completely extended on the slide which guides it, and in which the degrees of extension are determinable and can be executed at high accelerations. The drive devices are also to be located in such a way that they can be easily installed and supplied with electric power or hydraulic medium and also so that they can be easily and reliably maintained, with the result that they can be operated for long periods of time without the need for service.

This task is accomplished by the following features. The telescoping table has a base and at least two slides and a support table, which are guided in linear fashion on the base in a telescoping manner. At least two drive devices are mounted on the base, one of which is connected by drive means to the first slide only, whereas the second device operates cables and/or lengths of chain, which move the second slide or the second and additional slides as well as the support table. The first drive device operates a chain, which passes over guide pinions, the two ends of the chain crossing each other as they proceed to opposite ends of the first slide, to which they are attached. These features ensure a relatively simple design, and the forces of acceleration in question are transmitted purely by lengths of chain, so that even relatively large forces can be transmitted with almost no elastic stretching or yielding. Thus, by the use of separate drive devices, it is possible either to extend the second slide and any following slides and the support table or, to achieve greater extension, to extend additionally the first slide on the base as well. This means that, for the extensions required in practice, the support table is always fully extended, advisably by means of the second slide, whereas the first slide is also extended only when the degree of extension to be achieved requires it. Thus, in accordance with the task, the height of the telescoping components which must be moved into a shelving compartment at small extensions is advantageously limited, and the need for complicated arrangements to prop up the deposited loads can be dispensed with. Because the drive devices are installed on the base, there is sufficient room to install them, and no complications are to be expected from the supply lines for power and/or pressurized media, which can be laid permanently in the base. Permanent installation on the roomy base not only allows the device to be assembled quickly, easily, and reliably but also simplifies subsequent maintenance, so that desirably long service times and reliable operation without frequent breakdowns are to be expected.

Additional effective, advantageous, and inventive elaborations of the invention will be explained in the following.

BRIEF DESCRIPTION OF THE DRAWING

The various features of the invention are presented in detail below on the basis of a description of an exemplary embodiment and of the drawings which explain it.

DESCRIPTION OF THE PREFERRED EMBODIMENTS

Figure 1:
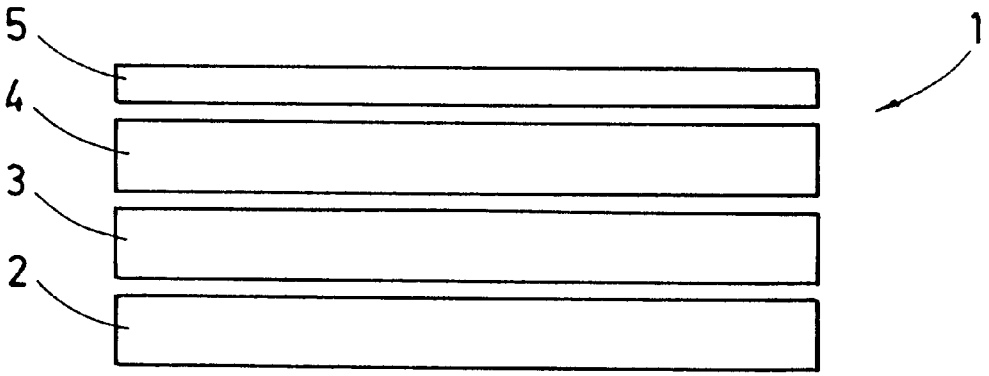
FIG. 1 shows a schematic diagram of a telescoping table in its rest position.

FIG. 1 shows a schematic diagram of a telescoping table 1 in its starting position, in which a first slide 3, a second slide 4, and a support table 5 are almost perfectly aligned with each other above base 2 of the table.

Figure 2:
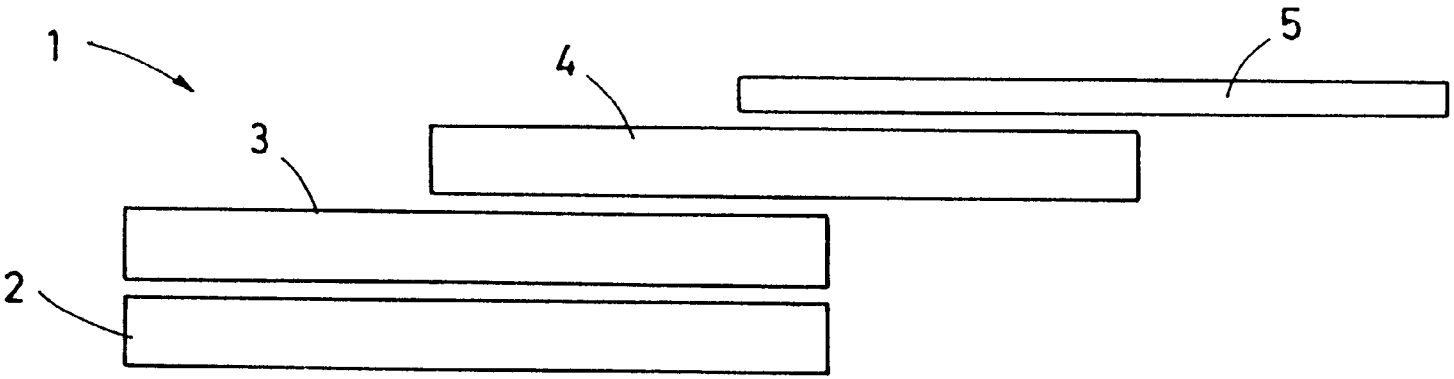
FIG. 2 shows the telescoping table of FIG. 1 after it has been partially extended.

FIG. 2 shows telescoping table 1 of FIG. 1 after it has been moved out to a certain fraction of its maximum extension; in this situation, first slide 3, operated by a first drive device, is still lined up with base 2, whereas second slide 4 and support table 5 have been fully extended by a second drive device. Thus, however, support table 5 and slide 4 now jut out over slide 3 to the maximum extent, and the end surface of slide 3 is as far away as possible from the extended telescoping components.

Figure 3:
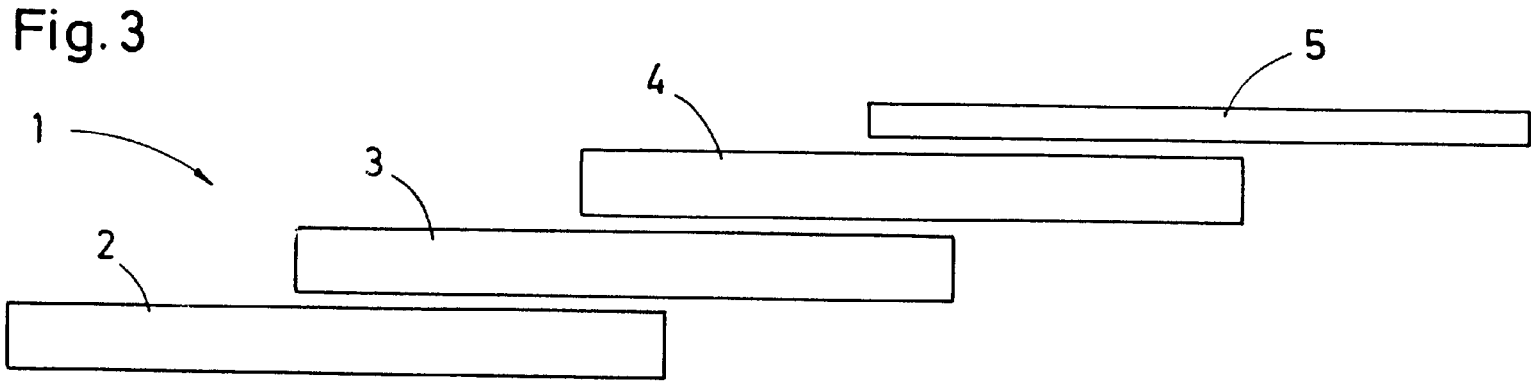
FIG. 3 shows the telescoping table of FIG. 1 at maximum extension.

FIG. 3 shows that, as a result of the action of the first drive device, slide 3 is now also extended versus base 2, and thus support table 5 has reached its maximum possible extension.

Figure 4:
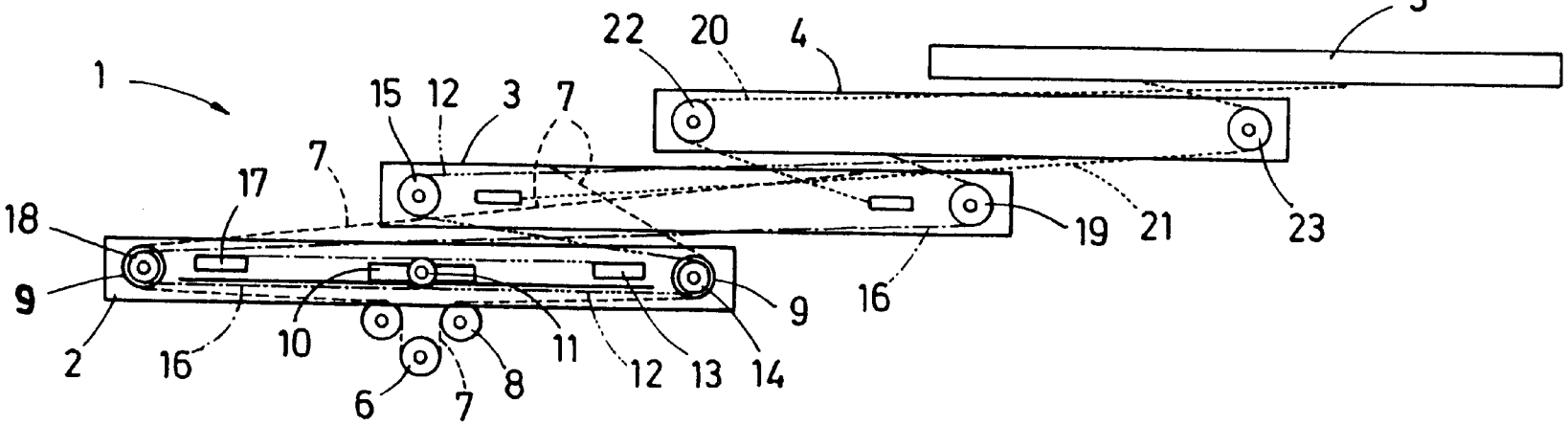
FIG. 4 shows a schematic diagram of the structure of the telescoping table of FIGS. 1–3.

FIG. 4, again in the form of a schematic diagram, shows telescoping table 1 with slide 3, slide 4, and support table 5, after they have been extended out from base 2. To move slide 3, a pinion 6 is provided, which is turned by a drive motor (not shown); the pinion engages with a chain 7. This chain, shown in broken line, passes around guide pinions 8 and 9, and its free ends then cross each other as they proceed to slide 3, to which they are attached at two points. When pinion 6 is now driven, the chain is moved in one of the two possible directions, one free end of chain 7 pulling while the other yields. Slide 3, which is connected to both ends of the chain, is thus pushed out of its position in a linear manner along its guide in base 2, which, for the sake of simplicity, is not shown in FIG. 4.

Base 2, however, is equipped with yet another drive device, which is not shown either, and which is able to displace a carriage 10 along a horizontal guide within base 2, as indicated by horizontal dashes. Carriage 10 carries a double pinion 11, which is supported on an axle so that it is free to rotate. One end of a tension chain 12, shown in dash-dot line with three dots, is attached to a chain take-up 13, from which it then proceeds toward double pinion 11, around which it makes a 180° turn. From double pinion 11, tension chain 12 now passes around another guide pinion 14, supported at the end of base 2, and proceeds from there to the facing side of slide 3, where it wraps around a guide pinion 15 supported at the opposite end. From here, the chain now proceeds back again to the opposite end of slide 4, to which it is attached. In an approximately symmetrical manner, one end of a tension chain 16 shown in dash-dot line, is attached to a chain take-up 17, wraps around the second pinion of double pinion 11, passes from there to guide pinion 18, which is supported at the end of base 2 opposite guide pinion 14. From here, tension chain 16 crosses tension chain 12 on its way to a guide pinion 19 supported at the opposite end of slide 3, and, crossing tension chain 12 again, is attached to slide 4 near the end. What this now means is as follows: When, for example, the second drive device (not shown) pushes carriage 10 to the right, the loop of tension chain 12 passing around double pinion 11 is shortened, and the end of this tension chain passing around guide pinions 14, 15 is lengthened. At the same time, however, the loop formed by tension chain 16 passing around double pinion 11 becomes larger, so that a corresponding length of tension chain is pulled out over guide pinions 18, 19, and slide 4 is thus shifted to the right in its linear guide by the free end of the chain.

This motion is also transmitted to support t able 5: Slide 3 is connected to support table 5 by two tension chains 20, 21, each shown by finely dashed lines. After first crossing each other, these chains pass around guide pinions 22, 23, which are supported at the two ends of slide 4. Guided by these guide pinions 22, 23, the free end sections of tension chains 21, 21 cross again, and their ends are then attached to support table 5. As a result, movements between slides 4 and 3 are also transmitted to support table 5, which moves with respect to slide 4.

Thus, by shifting carriage 10 by means of the second drive device (not shown) and by the use of tension chains 12, 16, 20, 21 provided as drive means, slide 4 can be extended on slide 3, and support table 5 can be extended on slide 4, as shown in FIG. 2, without the position of slide 3 on base 2 being changed. On the other hand, by actuation of the first of the drive devices (not shown), which acts by way of pinion 6 and chain 7 serving as drive means, the position of slide 3 on base 2 can be changed, in which case tension chains 12, 16, 20, 21, as a result of the displacement of guide pinions 15, 19, are able to push slide 4 and support table 5 out. This also means that, as an option, by actuating only the second drive device, slide 4 and support table 5 alone can be extended, which is usually sufficient for a small extension requirements such as those present when loads lying at the front of the shelving compartment are to be transferred. If a load situated farther toward the rear is to be picked up or deposited, then, instead of this, the first drive device is actuated, and slide 3 is extended with respect to base 2 along with slide 4 and the support table 5. The extension maneuvers of the telescoping components, furthermore, are not limited to either the complete extension of slide 4 and support table 5 alone or to the extension of all the telescoping elements; instead, any desired intermediate degrees can be selected, where advantageously slide 4 and support table 5 are extended completely first, and if any further extension is required, this is provided by the actuation of slide 3.

So as not to overload either the description or the figures, many details have not been either illustrated or described specifically. For example, support table 5 can slide in a linear manner in guideways on slide 4, which in turn can slide in guideways on slide 3, and this in turn slides in guideways on base 2. In addition, control means attached to the drive and/or stops can be used to limit the degrees to which the individual telescoping elements can extend. It is advantageous, furthermore, for the drive means to consist of two sets of components and for these two sets to be arranged symmetrically so as to avoid the torques which would impair the linear advance.

For the rest, the drive devices are not limited to electric motors, nor are the drive means limited to tension chains.

Thus, electric motors, especially geared motors, can be provided as drive devices, but hydraulic motors, pneumatic cylinders, etc., are also possible. In particular with respect to the drive of slide 3, endless chains in conjunction with pushers which engage with the chains can be used as drive means. In addition, a drive based on the use of a toothed rack has also proven to be advantageous; racks can also be in the form of flat-link articulated chains, which are stretched out tightly in a straight line. A drive based on tension cables, tension bands, and/or tension belts is also possible. A minor variant can also be obtained by not guiding tension chains 12, 16 around double pinions supported on carriage 12 but rather by connecting them directly to the carriage. This can be driven by a pneumatic cylinder, but pinions engaging in racks or spindle nuts mounted on driven, threaded spindles can also be used. Thus the invention can be varied in many different ways without departing from the basic inventive idea.

What is claimed is:

1. Telescoping table with a base and slides and a support table, wherein the slides and the support table are guided in linear fashion on the base in a telescoping manner, and with two or more drive devices mounted on the base, wherein a first one of the two or more drive devices is connected by drive means to a first one of the slides only, whereas a second one of the two or more drive devices operates tension members, which move at least a second one of the slides as well as the support table, wherein the first drive device operates a chain having two chain ends, each chain end being connected to opposite ends of the first slide (3), wherein the chain is guided from the first drive device over guide pinions (8, 9) and from the guide pinions (8, 9) to the opposite ends of the first slide (3), wherein the two chain ends cross each other between the guide pinions (8, 9) and the opposite ends of the first slide (3).

2. Telescoping table according to claim 1, wherein the second drive device operates a carriage (10) moveable in a longitudinal direction of the base (2), wherein the tension members are moveably attached to the carriage and pass around first guide means (14, 18) mounted at opposite ends of the base (2), wherein the tension members are guided from the first guide means so as to cross each other to additional guide means (15, 19) mounted at opposite ends of the first slide (3) and are guided about the additional guide means, and finally, after crossing each other again, are attached to the second slide (4) or guided over second additional guide means mounted at ends of the second slide (4).

3. Telescoping table according to claim 2, wherein the carriage (10) has two guide pulleys or pinions (11), and wherein the tension members (12, 16) have ends attached to the base (2) at points of attachment and are guided from the points of attachment in a 180° loop around the two guide pulleys or pinions to the first guide means.

4. Telescoping table according to claim 1, wherein the first drive device is an electric motor.

5. Telescoping table according to claim 1, wherein the second drive device is an electric motor, which operates a threaded spindle, and wherein a spindle nut mounted on the threaded spindle is connected to the carriage (10).

6. Telescoping table according to claim 1, wherein the second drive device has an electric motor which operates a pinion which engages in a toothed rack on the carriage (10).

7. Telescoping table according to claim 1, wherein the tension members are selected from the group consisting of tension cables, tension bands, tension belts, and tension chains.

8. Telescoping table according to claim 4, wherein the electric motor is a geared motor.

9. Telescoping table according to claim 5, wherein the electric motor is a geared motor.

10. Telescoping table according to claim 6, wherein the electric motor is a geared motor.

* * * * *